US005639228A

United States Patent [19]

Van De Venne et al.

[11] Patent Number: 5,639,228

[45] Date of Patent: Jun. 17, 1997

[54] ELECTRICALLY DRIVEN AIR PUMP HAVING FRICTION-FIT, AIR-TIGHT SEAL JOINTS

[75] Inventors: Günter Van De Venne, Mönchengladbach; Rainer Peters, Goch; Klaus Muckelmann, Düsseldorf, all of Germany

[73] Assignee: Pierburg GmbH, Neuss, Germany

[21] Appl. No.: 549,959

[22] Filed: Oct. 30, 1995

[30] Foreign Application Priority Data

Oct. 29, 1994 [DE] Germany ..... 44 38 747.4

[51] Int. Cl.[6] ..... F04D 29/02; F04D 29/66; F04D 25/08

[52] U.S. Cl. ..... 417/423.14; 415/214.1

[58] Field of Search ..... 417/423.14; 415/214.1

[56] References Cited

U.S. PATENT DOCUMENTS

| | | | |
|---|---|---|---|
| 4,152,096 | 5/1979 | Murakami et al. | 415/214.1 X |
| 5,110,266 | 5/1992 | Toyoshima et al. | 417/423.14 X |
| 5,364,238 | 11/1994 | Yu | 417/423.14 |
| 5,388,970 | 2/1995 | Muckelmann et al. . | |
| 5,452,987 | 9/1995 | Bleger et al. | 415/214.1 |

FOREIGN PATENT DOCUMENTS

| | | |
|---|---|---|
| 0607515 | 7/1994 | European Pat. Off. . |
| 4107049 | 9/1992 | Germany . |

OTHER PUBLICATIONS

Database WPI, Section CH, Week 7502 Derwent Publications Ltd. London GB, AN 75–02201w.

*Primary Examiner*—Richard E. Gluck
*Attorney, Agent, or Firm*—Ladas & Parry

[57] ABSTRACT

An electrically driven air pump having a pump mechanism in a first section of a housing and an electric motor in a second section of the housing in driving engagement with the pump mechanism. First and second end covers are sealingly secured on the housing. The electric motor is supported by elastomer rings in the housing. The pump mechanism has a rotor wheel driven by the motor and a stator wheel adjacent to the rotor wheel. A first lock joint is formed between the first cover and both the stator wheel and the housing and a second lock joint is formed between the second cover and the housing. The covers, stator wheel and housing are made of plastic material and the lock joints are formed by air-tight, friction-fit between the engaged parts which are deformed elastically or plastically.

16 Claims, 2 Drawing Sheets

ELECTRICALLY DRIVEN AIR PUMP HAVING FRICTION-FIT, AIR-TIGHT SEAL JOINTS

FIELD OF THE INVENTION

The invention relates to an electrically driven air pump, such as for use in motor vehicles to pump secondary air into the exhaust system in order to reduce pollutants in the exhaust gases.

BACKGROUND AND PRIOR ART

U.S. Pat. No. 5,110,226 discloses an electrically driven air pump whose operation is accompanied by vibrations of variable magnitude due to imbalance of the impeller on wheel and the electric motor as well as to the magnetic rotating field which is produced. These vibrations are transported to the pump support or to the apparatus to which it is connected and produces a high frequency operating noise.

DE-A1 41 07 049 discloses an electrically driven air pump which includes means for reducing the vibration and operating noise. Principally, such means comprises two elastomer rings between the electric motor and the housing for support of the motor. The rings are arranged between the electric motor and the housing in a particular fashion in which the second ring is supported by the housing through a spring acting under tension between a cover and the elastomer ring.

Although the above measures lead to a reduction in the vibration and operating noise of the electrically driven air pump, it involves considerable cost for the manufacture of the structural parts. In addition, the various sealed joints may become unsealed due to the multiplicity of structural parts which are connected by screws whereby the efficiency of the pump is reduced.

SUMMARY OF THE INVENTION

An object of the invention is to provide an air pump having reduced vibration and operating noise with permanent, sealed joints and with a simplified construction of the pump.

In order to achieve the above and further objects, a pump mechanism is supported in a first section of the housing of the air pump and the electric motor is supported in a second section of the housing and is in driving engagement with the pump mechanism. First and second covers are sealingly placed on the first and second sections of the housing, respectively, and elastomer rings are provided in the second section of the housing to support the electric motor therein. In accordance with the invention, friction-fit lock joints are provided between the first cover and both a stator wheel of the pump mechanism and the housing. Each friction-fit lock Joint provides an air-tight sealed engagement between the parts at said joint.

In further accordance with the invention, each of the friction-fit lock joints comprises a press fit engagement between the locked parts at which said parts are in deformed engagement. The deformed engagement can be an elastic or plastic deformation of the parts.

In further accordance with the invention, the cover for the second section of the housing is also engaged therewith by a friction-fit lock joint.

DETAILED DESCRIPTION OF A PREFERRED EMBODIMENT

Figure 1:
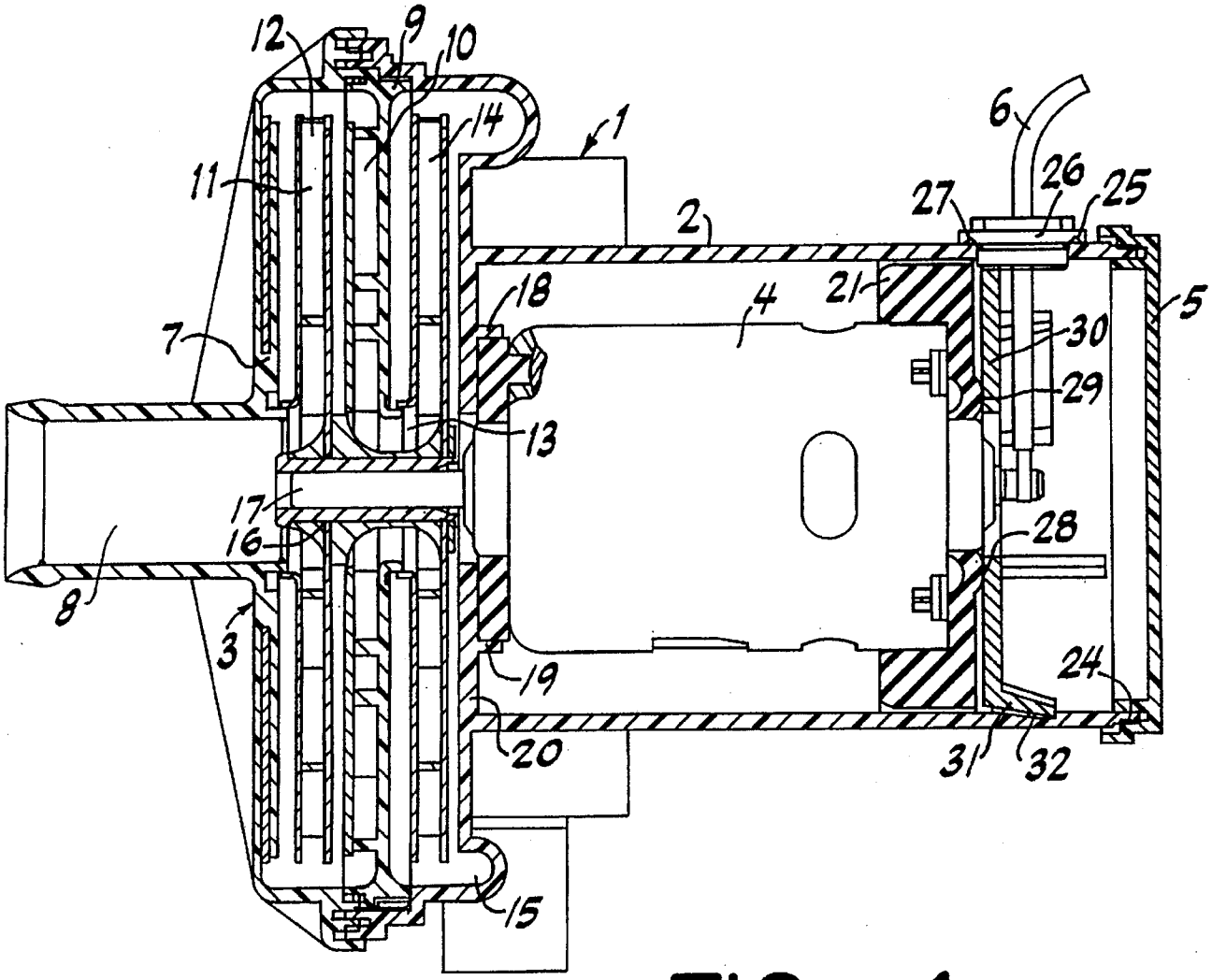
FIG. 1 is a longitudinal section through one embodiment of an electrically driven air pump apparatus according to the invention.

FIG. 1 shows an air pump 1 for pumping secondary air to an exhaust system of an internal combustion engine (not shown). The pump 1 comprises a housing 2, made of plastic material, having a first section receiving a pump mechanism 3 and a second section receiving an electric motor 4. A cover 5 is secured on the second section of the housing and forms an air-tight seal thereat. An electrical cable 6 of the motor 4 extends from the motor through a side wall of the housing. At the opposite end of the housing, a cover 7 seals the first section of the housing containing the pump mechanism 3. The cover 7 has a connector 8 for inlet of air into the housing.

The pump mechanism 3 comprises a stationary guide vane or a stator wheel 9 having channels 10 for air guidance, a first impeller or rotor wheel 11 disposed adjacent to the stator wheel 9 to receive the inlet air from connector 8 and to pump the air radially outwards for discharge at outlet 12, where the air is directed by the channels 10 in the stator wheel 9 inwardly to an inlet 13 of a second impeller or rotor wheel 14 disposed on the side of the stator wheel opposite the rotor wheel 11. This arrangement represents a two stage pumping section and if more stages are provided, a subsequent stator wheel and rotor wheel follow the rotor wheel 14. The housing 2 is provided with an annular channel 15 which receives the pumped air from the rotor wheel of the last pumping stage (rotor wheel 14 in FIG. 1) to discharge the air under pressure to an outlet connection (not shown) which supplies the air to the internal combustion engine.

The electric motor 4 is supported in the second section of the housing by first and second elastomer rings 18 and 21. The first elastomer ring 18 is mounted in a recess 19 in a housing wall 20 separating the first and second sections of the housing.

In accordance with the invention, the electric motor 4, with the rotor wheels 11 and 14 installed on the motor shaft 17, is balanced while the first pump section is still open i.e. cover 7 has not yet been installed. In order to balance the motor, balance weights are placed on the rotor wheel 11. The stator wheel 9 is arranged between the rotor wheels 11 and 14 and the stator wheel is secured in housing 2 radially, axially and rotationally and is sealed in air-tight relation when the cover 7 is mounted on the housing. Thereby, the pump pressure stages are separated from one another by the stator wheel.

Figure 2:
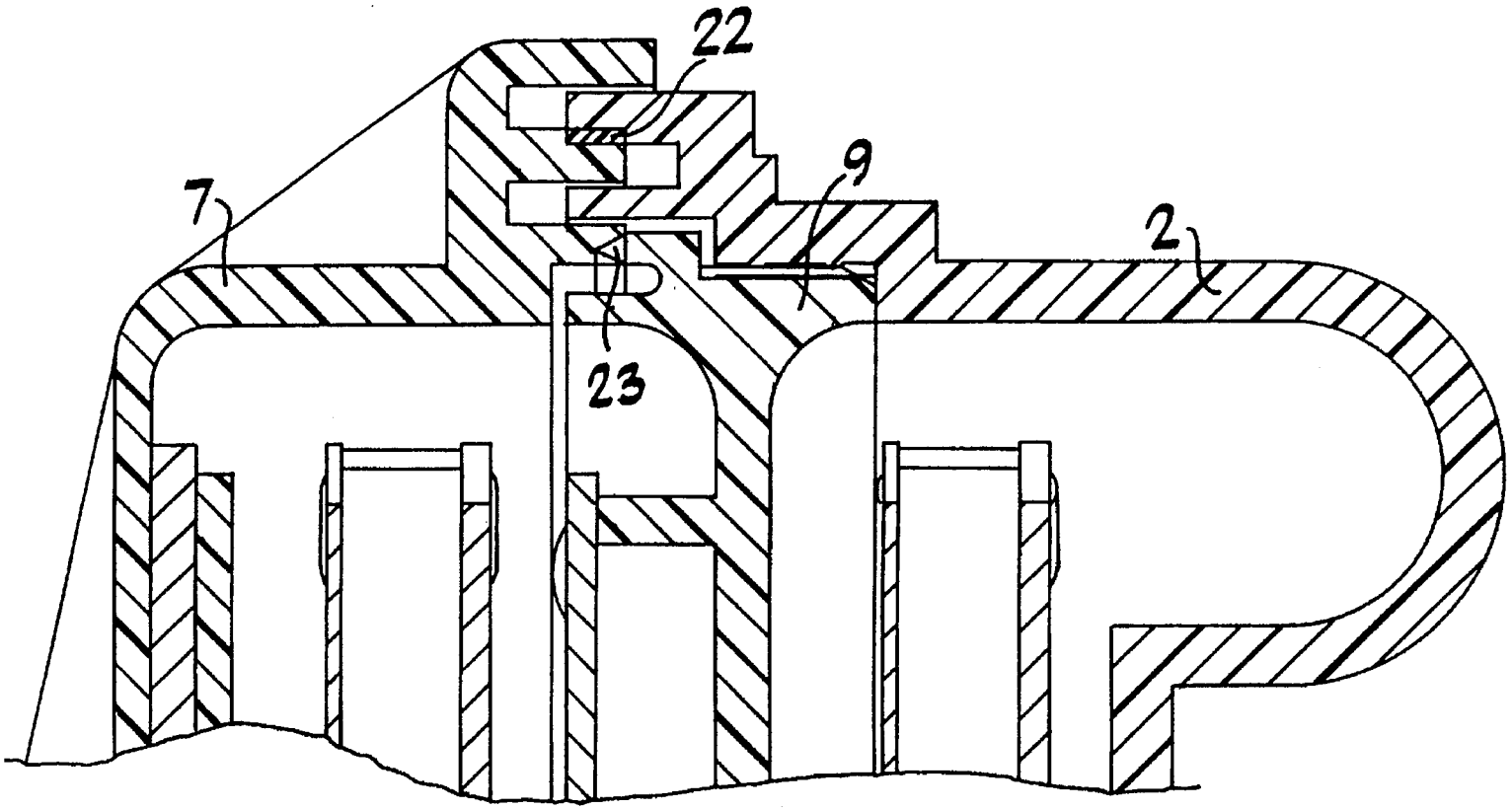
FIG. 2 is a detailed view on enlarged scale of a portion of the apparatus of FIG. 1.

The cover 7, stator wheel 9 and housing 2 are made of plastic material and are joined and sealed by friction-fit, lock joints 22 and 23 between the engaged parts. The lock joints are formed by an interference fit between the engaged parts at the joints, which results in elastic or plastic deformation between the parts. Referring in particular to FIG. 2, lock joint 22 is formed between annular legs on cover 7 and housing 2 facing one another, while the lock joint 23 is provided between annular legs on the cover 7 and the stator wheel 9 facing one another. The lock joints 22, 23 are formed by forcing the cover 7 onto the housing 2 and the stator wheel 9, which produces elastic and/or plastic deformation between the mating parts and an air-tight, friction-fit seal thereat. In the case of seal joint 23, the annular edge of the stator wheel 9 is formed with a sharp point to bite into the depending leg of the cover 7 to produce the friction-fit joint. At joint 22, an interference fit is achieved between the mating parts which results in an annular, frictional fit therebetween.

The seal joints are produced by press fitting the cover 7 on the housing 2 and the stator wheel 9 which constitutes a substantial improvement over the construction heretofore known in the art which required a number of structural parts. gaskets and fasteners, all of which are eliminated. Moveover, the joints 22 and 23 are air-tight and remain so indefinitely.

In order to permit the electrical cable 6 to pass through the side wall of the housing 2, the wall is provided with an opening 25 whose axis extends at right angles to the longitudinal axis of the motor 4.

The opening 25 is closed and sealed by a seal cap 26. The cover 5 is closed and sealed on the housing 2 by a friction-fit joint 24. A friction-fit joint 25 is formed between the cap 26 and the housing 2. In this way, all of the structural parts are joined in airtight, sealed engagement by frictional joints produced by elastic or plastic deformation due to interference fit at joints 22–25.

In order to apply a resilient axial force to the electric motor 4 to urge the motor against the elastomer ring 18, the elastomer ring 21 is formed with an annular bead 28 that can be elastically deformed in the axial direction. The bead 28 bears against a surface 29 of a support ring 30 which is provided with radially projecting clips 31 engaged in corresponding recesses 32 in the side wall of housing 2. This arrangement reduces operating noise and simplifies the mounting of the electrical motor with a minimum number of parts.

Although the invention has been described in relation to a specific embodiment thereof, it will become apparent to those skilled in the art that numerous modifications and variations can be made within the scope and spirit of the invention as defined in the attached claims.

What is claimed is:

1. An electrically driven air pump comprising:

a housing having first and second sections;

a pump mechanism in said first section;

an electric motor in said second section in driving engagement with said pump mechanism;

first and second end covers sealingly on said first and second sections of the housing, respectively;

elastomer means supporting said electric motor in said second section of the housing;

said pump mechanism comprising a rotor wheel driven by said motor, and a stator wheel adjacent to said rotor wheel; and a seal connection between said first cover and both said stator wheel and said first section of the housing, said first cover, said stator wheel and said first section of the housing being made of plastic material and said seal connection comprising means providing an air-tight friction-fit between said first cover and said stator wheel and housing.

2. An electrically driven air pump as claimed in claim 1, wherein said means of said seal connection comprises a first friction-fit joint between said first cover and said stator wheel and a second friction-fit joint between said first cover and said first section of the housing.

3. An electrically driven air pump as claimed in claim 2, wherein said first cover and said stator wheel include, at said first joint, frictionally engaged parts.

4. An electrically driven air pump as claimed in claim 3, wherein said frictionally engaged parts are in interference fit and said frictionally engaged parts are deformed, at said first joint.

5. An electrically driven air pump as claimed in claim 2, wherein said first cover and said first section of the housing include, at said second joint, frictionally engaged parts.

6. An electrically driven air pump as claimed in claim 5, wherein said frictionally engaged parts are in interference fit and said frictionally engaged parts are deformed, at said second joint.

7. An electrically driven air pump as claimed in claim 2, wherein said first and second joints extend angularly.

8. An electrically driven air pump as claimed in claim 1, wherein said pump mechanism further comprises a second rotor wheel driven by said motor, said stator wheel being between the rotor wheels.

9. An electrically driven air pump as claimed in claim 4, wherein said frictionally engaged parts are deformed elastically.

10. An electrically driven air pump as claimed in claim 6, wherein said frictionally engaged parts are deformed elastically.

11. An electrically driven air pump as claimed in claim 1, wherein said electric motor includes an electrical cable, said second section of said housing having an opening through which said electrical cable passes, a sealing cap in said hole for sealing said cable, and a friction-fit lock joint at said opening between said sealing cap and said second section of said housing.

12. An electrically driven air pump as claimed in claim 11, wherein said electric motor has a longitudinal axis and said housing has a wall surrounding the electric motor and extending parallel to said longitudinal axis thereof, said opening being provided in said wall.

13. An electrically driven air pump as claimed in claim 12, wherein said opening has an axis at right angles to the longitudinal axis if the motor.

14. An electrically driven air pump as claimed in claim 1, comprising a support ring in said second section of the housing, said elastomer means comprising first and second elastomer rings supporting the motor in the second section of the housing at axially spaced locations along said motor, one of said elastomer rings being interposed between said electric motor and said support ring and including an axially deformable bead bearing against said support ring, said support ring including radial projections engaged in recesses provided in said housing whereby resilient axial force is applied by said bead to said electric motor to urge the motor against the other elastomer ring.

15. An electrically driven air pump as claimed in claim 4, wherein said frictionally engaged parts are deformed plastically.

16. An electrically driven air pump as claimed in claim 6, wherein said frictionally engaged parts are deformed plastically.

* * * * *